United States Patent [19]

Reynolds

[11] 4,183,318

[45] Jan. 15, 1980

[54] FOUR BELT CONVEYING MECHANISM FOR TUBULAR KNIT GUMMING AND SLITTING MACHINE

[75] Inventor: James R. Reynolds, Spartanburg, S.C.

[73] Assignee: Milliken Research Corporation, Spartanburg, S.C.

[21] Appl. No.: 900,260

[22] Filed: Apr. 26, 1978

[51] Int. Cl.[2] ..... D06C 5/00; B05C 11/00

[52] U.S. Cl. ..... 118/34; 118/38; 118/67; 26/81; 26/82; 34/105; 26/85

[58] Field of Search ..... 26/81, 82, 85; 34/21, 34/105; 118/38, 34, 67; 427/176, 289

[56] References Cited

U.S. PATENT DOCUMENTS

| | | | |
|---|---|---|---|
| 1,107,162 | 8/1914 | Firsching | 26/85 |
| 3,289,510 | 12/1966 | Carter et al. | 26/82 X |
| 3,402,059 | 9/1968 | Cohn et al. | 118/38 X |
| 3,703,882 | 11/1972 | Haft | 118/38 X |

FOREIGN PATENT DOCUMENTS

| | | | |
|---|---|---|---|
| 1140700 | 12/1962 | Fed. Rep. of Germany | 26/85 |
| 2422657 | 6/1975 | Fed. Rep. of Germany | 26/82 |
| 1217993 | 1/1971 | United Kingdom | 26/82 |

*Primary Examiner*—Robert Mackey

*Attorney, Agent, or Firm*—Earle R. Marden; H. William Petry

[57] ABSTRACT

A machine to process fabric knit in tubular form which includes apparatus to lay down a stripe of a gumming composition to allow the tubular fabric to be slit in the center of the solidified gumming stripe. The slit knit fabric is then opened up to full width and taken up. The tubular knit goods are conveyed through the gumming and slitting operation by a four belt conveying system which allows the lengthwise tension and the width of the tubular fabric to be controlled.

7 Claims, 6 Drawing Figures

FOUR BELT CONVEYING MECHANISM FOR TUBULAR KNIT GUMMING AND SLITTING MACHINE

In the knit goods field, it is conventional to manufacture knitted fabrics on circular knitting machines, the production of such machines being a continuous tube of knitted fabric. Frequently, it is possible to process and utilize the fabric in tubular form. However, for a large and increasing variety of end uses, such as coated or laminated materials, printed fabrics, etc., it is necessary or desirable to handle and utilize the knit fabric in flat, open width form which necessitates, at some stage in the processing of the fabric, the slitting of the fabric tube and the subsequent opening of the slit tube to enable the fabric to be presented in flat form.

Since knitted fabric, as distinguished from most woven fabrics, for example, is easily distortable in any direction and is usually subject to internal tensions in the stitches of the yarn, the slitting of a tube of knit fabric is often accompanied by a severe curling of the slit edges, which makes the subsequent opening and gathering of the slit material difficult and also complicates the necessary subsequent handling and processing of the material. For this reason, it has been conventional practice in the knit goods industry to apply a stripe of gumming composition to the knit fabric before slitting. After drying or curing of the gumming composition, the edges of the fabric are relatively stiff, and the knit fabric tube can be slit along the center of the gummed stripe. The cured or dried gumming composition serves to maintain the integrity of the slit edges and to prevent excessive curling and distortion thereof.

While the foregoing practice is conventional in the most general sense, its actual performance on an industrial or commercial basis has been characterized by inefficiency, excessive expense and a substantial inability to achieve consistently controllable final results. Largely, this has been due to the fact that the several operations involved in converting the tubular knitted fabric from tubular form to flat, open width, gathered form have not, in the past, included the critical steps of geometrically orienting the fabric and maintaining its desired geometry throughout. This has been aggravated by the fact that the several operations involved often were required to be carried out separately and often at different times and places, resulting in a critical lack of continuity and control. The several handlings of the material have made very remote and difficult indeed the desired objective of achieving uniform and consistent performance as regards the dimensions and other geometric characteristics of the gathered, open width material.

It is therefore an object of the invention to provide a novel apparatus and its method of use to continuously receive a web of tubular knit fabric and convert it into open width knit fabric with stabilized selvedges.

Other objects of the invention will become readily apparent as the specification proceeds to describe the invention with reference to the accompanying drawings in which.

Figure 1:
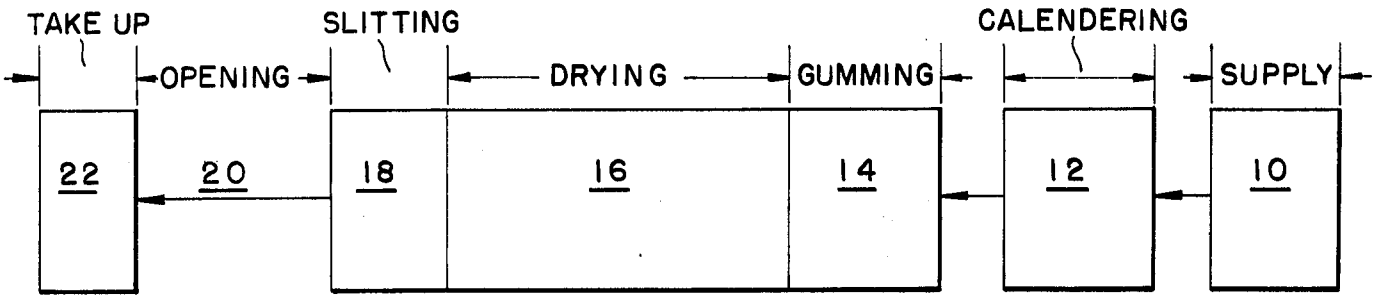
FIG. 1 is a schematic flow diagram of the continuous movement of the tubular knit fabric.

Looking now to the drawings and in particular to FIG. 1, the invention will be explained. FIG. 1 represents the flow of tubular knit fabric "F" through a gumming and slitting operation to produce an open width fabric. The tubular knit fabric in either roll form or folded form is delivered to the calender 12 from a supply 10 to calender and steam the fabric prior to delivery to the gumming and slitting machine. From the calender 12, the tubular fabric is relaxed before being loaded upon the four belts for guiding through the gumming stage 14 whereat a stripe 13 of suitable gumming material is applied to one layer of the fabric before passage through the dryer 16 to set the applied gum material. The tubular fabric is conveyed by the conveying system to the slitter 18 where the stripe of gummed material is slit in the center thereof so that the tube of material can be opened at the opening station 20 and taken up in flat form by a suitable take-up 22.

Figure 2:
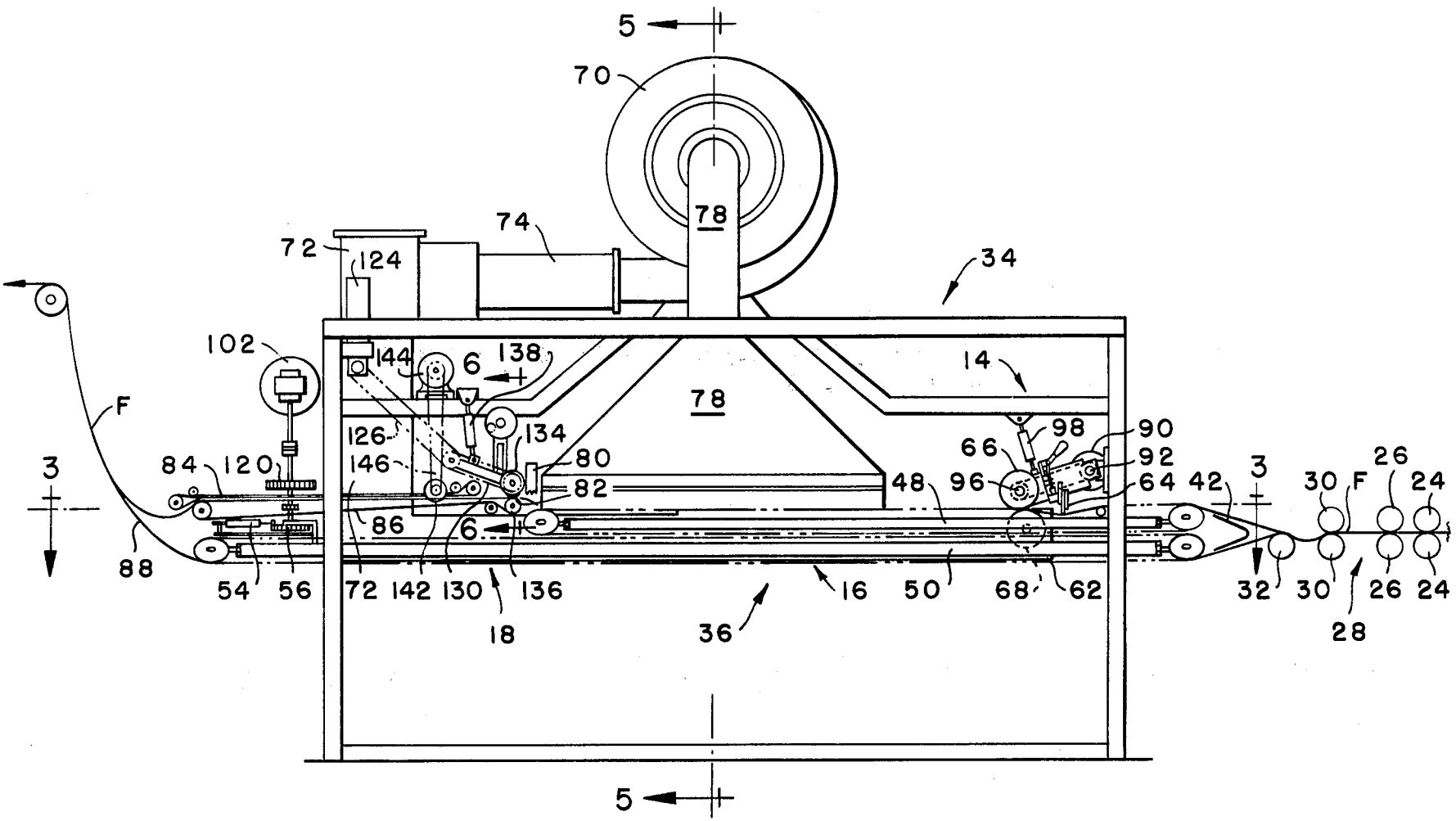
FIG. 2 is a side elevation view of the gumming and slitting portion of the machine.

Looking now to FIG. 2 a more detailed side elevation view of the apparatus is shown. The calender section 12 of FIG. 2 is represented by a pair of driven nip rolls 24 and a pair of calendar drive rolls 26. The tubular knit fabric "F" is steamed and relaxed in the area generally designated 28 prior to delivery to driven nip rolls 30. From the nip rolls 30, the fabric "F" in tubular form is delivered over the support roll 32 to the gumming and slitting machine, generally designated 34.

Figure 3:
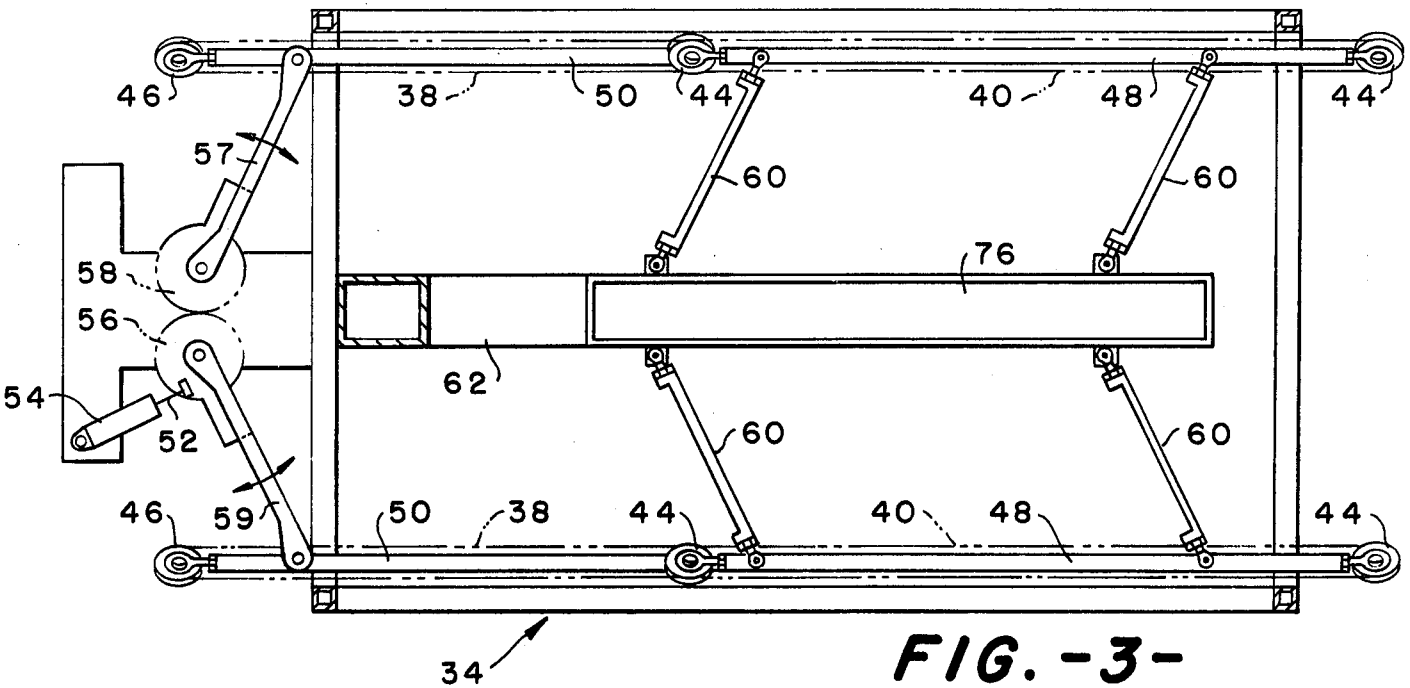
FIG. 3 is a top view of the adjustable belt system taken on line 3—3 of FIG. 2.
Figure 5:
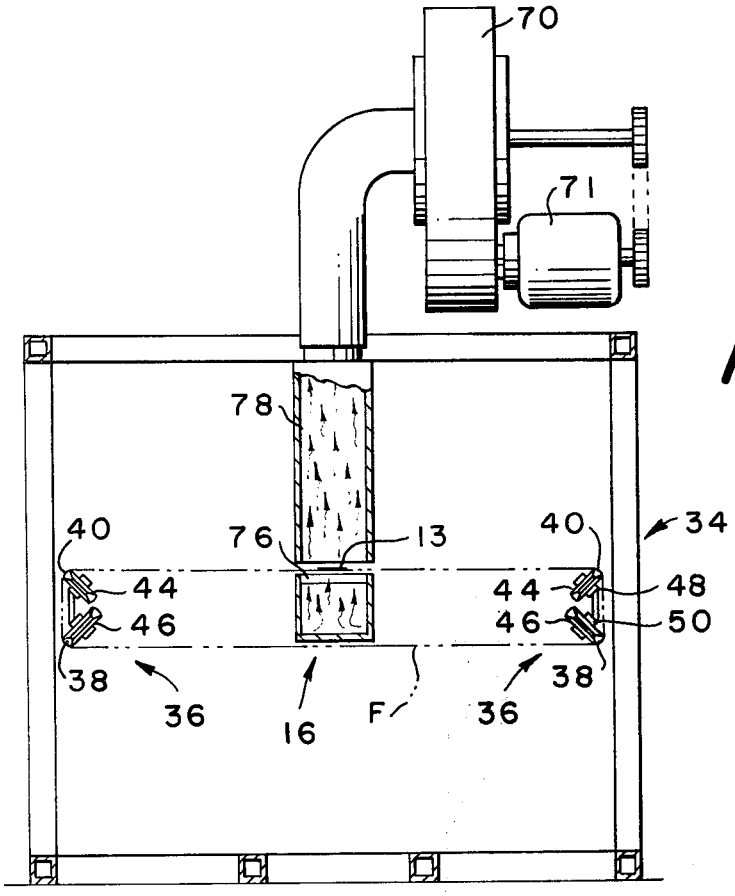
FIG. 5 is a section view taken on line 5—5 of FIG. 2 showing the stripe drying system.

As shown schematically in FIG. 1, the gumming and slitting machine consists of the gumming section 14, the drying section 16 and the slitting section 18. The tubular knit fabric "F" from the calendar nip rolls is spread onto a four belt guiding system 36, which consists of two long belts 38 and two shorter belts 40, by a triangular shaped spreader 42. The guide pulleys 44 for the upper short belts 40 are mounted so that their axes are mounted at an angle of approximately 45° to the horizontal and at an angle of approximately 90° to the axes of the guide pulleys 46 for the lower longer belts 38 to guide, spread and maintain the fabric "F" in a rectangular shape until it passes through the drying zone 16 as shown in FIG. 5. On each side of the machine 34, the support member 48 for the pulleys 44 are connected to the support member 50 for the pulleys 46 so that when the support member 50 is moved inward or outward, the support member 48 moves with it. This movement, inward or outward controls the width tension on the fabric "F" and, as shown in FIG. 3, is dependent on the position of the cylinder rod 52 of the cylinder 54. The cylinder rod 52 is connected to the gear 56 which meshes with gear 58 so that when the cylinder rod 52 is moved, it in turn through the gears 56 and 58 moves the support members 50 inward or outward by the action of levers 57 and 59. Movement of the support members 50 automatically moves the support members 48 connected thereto and which are guided in its movement by guide rods 60 pivotally connected to the support member 48 at one end and to the heater manifold 62 at the other end.

When the belt system has been adjusted to provide the configuration shown in FIG. 5, the fabric "F" passes to the gumming station 14 where the stripe 13 of polyvinyl acetate or other suitable material is extruded onto the fabric by an extruder 64 and then passes between the nip rolls 66 and 68 to cause the gum material or solution to be pressed into the fabric. The fabric "F" then is guided by the four belt system to the drying station 16 to set or harden the stripe of gum solution.

The drying station 16 consists of a centrifuged fan 70 driven by motor 71, mounted on top of the machine 34 with its outlet supplying hot air to the manifold 62 through the heater 72 and suitable connecting duct 74. From the manifold 62 located within the confines of the fabric (FIG. 5) the hot air is supplied upwardly from the outlet 76 through the gummed stripe on the fabric into the exhaust duct or outlet 78 which is connected to the inlet of the fan 70. Located on the downstream side of the exhaust duct 78 is mounted a cool air duct 80 which supplies ambient air on the gummed stripe to cool same as the fabric exits from the dryer 16. Cool air duct 80 is supplied ambient air by a suitable separate fan (not shown).

As the tubular knit fabric "F" with dried stripe 13 thereon passes from under the cooling duct 80, it is released from the upper belts 40 to allow the fabric width to relax to eliminate the tendency of the fabric to curl when cut by the rotary cutter 82, force on which is controlled by a suitable pressure device such as cylinder 83. The fabric "F" is then slit in the center of the stripe 13 and conveyed to the outlet end of the machine by the lower belts 38 and the pairs of belts 84 and 86. The belts 84 and 86 are narrow belts mounted on both sides of the slit areas of the fabric to grasp both sides of the fabric and carry it to the outlet end of the machine without the fabric opening up at the slit portion. The slit fabric "F" at the outlet end of the machine is allowed to form a free loop 88 and be opened and taken up by any suitable means.

Figure 4:
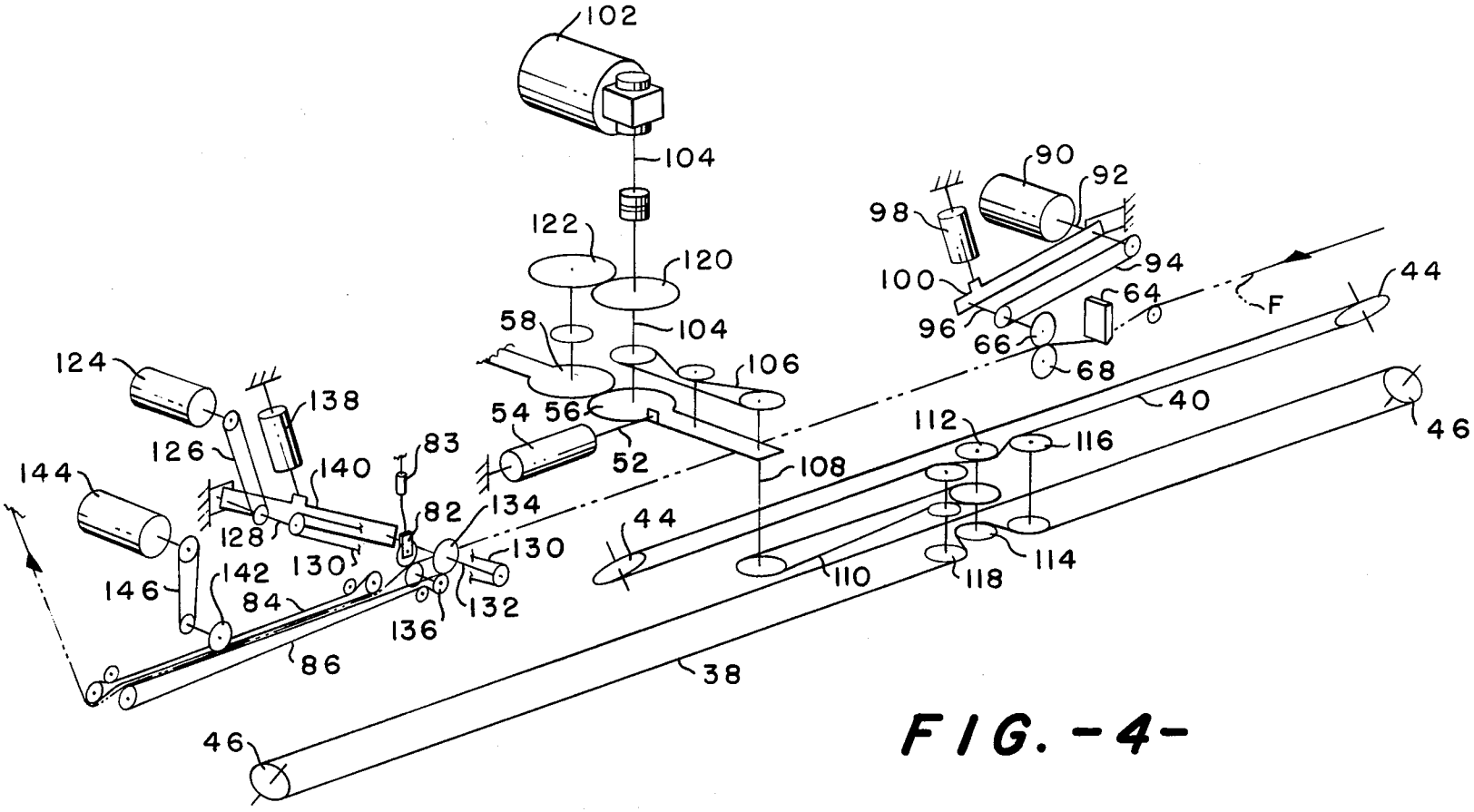
FIG. 4 is a schematic view of the essential drive system of the machine.

FIG. 4 represents basically the drive system for the gumming and slitting machine 34 and only shows one side of the machine since the other side is substantially identical. The nip roll 66 is driven by a motor 90 through shaft 92, belt 94 and shaft 96. A cylinder 98 is connected to machine 34 to exert a pressure on lever arm 100 connected to shaft 96 to control the pressure between nip rolls 66 and 68.

The four belt fabric transfer system 36 is driven by a motor 102, shaft 104, timing belt 106, shaft 108 and timing belt 110. Belt 110 in turn drives pully 112 for the upper belt 40 and pulley 114 for the lower belt 38 through suitable pulleys and shafts. Adjustable idler pulleys 116 and 118 are provided to control the tension in belts 38 and 40. A pair of gears 120 and 122 are driven by shaft 104 to transmit drive power to the other set of belts 38 and 40.

The pairs of belts 84 and 86 are driven by motor 124 through belts 126, shaft 128, belt 130, shaft 132 and roll 134 in pressure engagement with roll 136 around which is located belt 86. The pressure of roll 134 or roll 136 is controlled by pressure cylinder 138 acting against lever arm 140 to which roll 134 is attached. Belt 134 and the passage of fabric "F" therebetween drives the upper narrow belts 84.

If desired, a secondary cutter 142, driven by motor 144 and belt 146, can be used to insure that the stripe 13 of the fabric "F" has been completely severed so that the tubular knit fabric will open clearly at the opening station 20.

Figure 6:
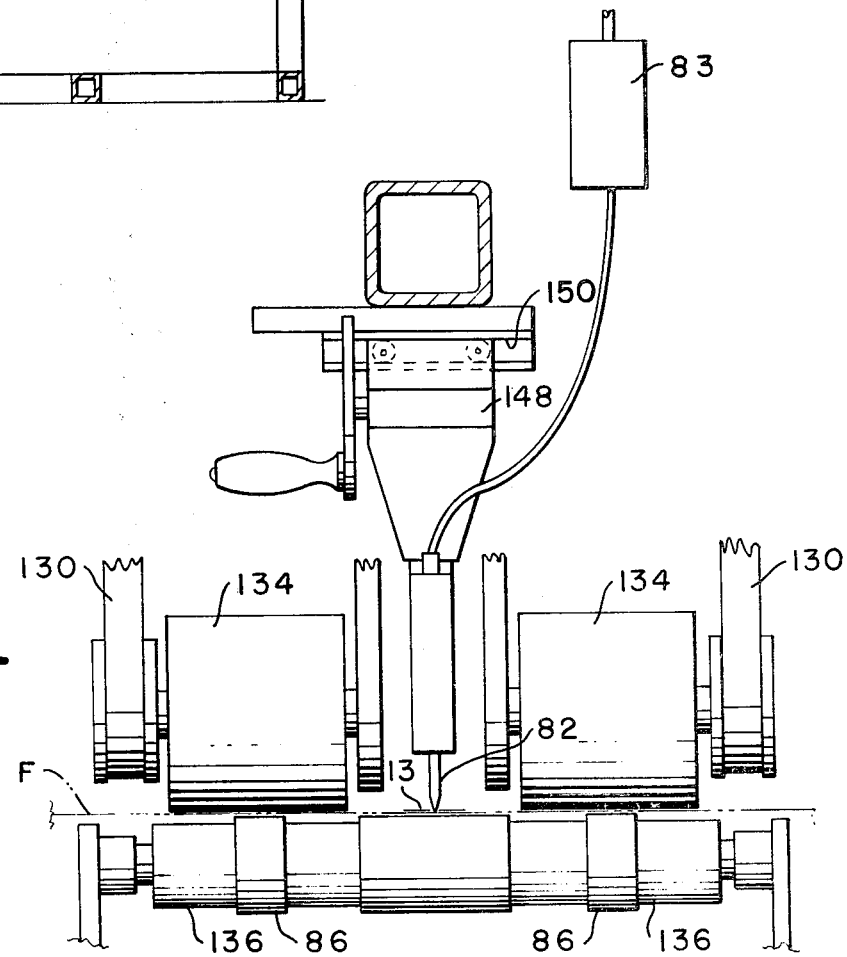
FIG. 6 is an elevation view taken on line 6—6 of FIG. 2 showing the main cutter arrangement.

Looking at FIG. 6, it can be seen that the horizontal position of the cutter 82 can be adjusted by sliding the cutter support plate 148 in the track 150 to correct the position of the cutter 82 relative to the stripe 13 in the tubular knit fabric "F".

Although I have described specifically the preferred embodiment of the invention, it is contemplated that changes may be made without departing from the scope or spirit of the invention and I desire to be limited only by the scope of the claims.

That which I claim is:

1. Apparatus for continuously converting tubular knitted fabric to open-width form comprising: conveying means to convey the tubular knit fabric in distended form, means to supply tubular knit fabric to said conveying means, said conveying means including at least two pairs of parallelling mounted endless belts, one pair of said belts being spaced laterally from the other pair of said belts, said means to supply tubular knit fabric including a means to guide the tubular knit fabric onto said belts, means mounted in cooperative relationship with said conveying means for successively applying a gumming composition, means for effecting setting thereof and means for slitting the fabric longitudinally along the linear area of the gumming composition and means downstream of the slitting apparatus to take-up the slit fabric in open-width form, each of said pairs of belts including a long belt and a short belt, said short belt turning around at a point between the means to set the gumming composition and the means to slit to allow the fabric width to relax to eliminate the tendency of the fabric to curl when slit.

2. The apparatus of claim 1 wherein the short belt and the long belt of each pair are vertically spaced from one another whereby the tubular fabric is held in a substantially rectangular shape.

3. The apparatus of claim 2 wherein a plane through the axis of the short belt forms a substantial angle to a plane through the axis of the long belt in each pair.

4. The apparatus of claim 3 wherein said angle is an acute angle.

5. The apparatus of claim 3 wherein said angle is a right angle.

6. The apparatus of claim 2 wherein said means for effecting setting comprises a heating means mounted internally of the tubular fabric within the confines of the rectangular shape.

7. The apparatus of claim 6 wherein said heating means is mounted on said apparatus to set the gumming composition and a cooling means is provided downstream of said heating means to cool the heated gumming composition.

* * * * *